United States Patent [19]
Kaup
[11] 4,395,188
[45] Jul. 26, 1983

[54] LOAD CARRYING ARRANGEMENT FOR A LIFT TRUCK

[75] Inventor: Otmar Kaup, Aschaffenburg, Fed. Rep. of Germany

[73] Assignee: Kaup & Co. KG, Aschaffenburg, Fed. Rep. of Germany

[21] Appl. No.: 258,796

[22] Filed: Apr. 29, 1981

[30] Foreign Application Priority Data

May 12, 1980 [DE] Fed. Rep. of Germany ..... 3007899

[51] Int. Cl.[3] ..... B66F 9/18; B66F 9/14

[52] U.S. Cl. ..... 414/622; 414/785; 414/667

[58] Field of Search ..... 414/622, 663, 664, 667, 414/668, 671, 785, 607, 665, 666, 629, 631, 641, 642; 187/9 R; 294/81 SF, 67 A, 67 DA, 67 DB

[56] References Cited

U.S. PATENT DOCUMENTS

| | | | |
|---|---|---|---|
| 3,133,655 | 5/1964 | Gardner | 414/622 |
| 3,455,476 | 7/1969 | Grigsby | 414/622 |
| 3,780,877 | 12/1973 | Levitt | 294/81 SF |
| 4,017,110 | 4/1977 | Pease et al. | 414/607 |

FOREIGN PATENT DOCUMENTS

| | | | |
|---|---|---|---|
| 2390370 | 12/1979 | France | 414/622 |

*Primary Examiner*—Robert B. Reeves
*Assistant Examiner*—James Barlow
*Attorney, Agent, or Firm*—Ernest F. Marmorek

[57] ABSTRACT

A load carrying arrangement for a lift truck includes two spaced apart hollow upright elongated members which are mounted on a mounting element that is displaceably mounted on the frame of the truck, and at least one load-engaging attachment which has at least one load-engaging portion and two mounting portions introducible into the interiors of the corresponding upright members through the open ends thereof to mount the load-engaging attachment on the upright members and thus on the mounting element. Fixing elements, such as pins or bolts extending through aligned bores in the upright members and in the mounting portions, positionally fix the mounting portions within the corresponding upright members. The attachment may be constituted by a pair of fork prongs each of which has a load-engaging portion and a mounting portion which is introducible either into the open upper end or into the lower end of the respective upright member, or a container spreader whose load-engaging portion is adapted to engage a container and whose mounting portions are introducible into the upper open ends of the upright members. Additional attachments having corresponding mounting portions may also be mounted on the upright members in the same manner. When at least one of the upright members is mounted on the mounting element for movement toward and away from the other upright member, a roller is arranged at the lower end of the movable upright member and engages a track arranged at the corresponding region of the mounting element, throughout the range of movement of the movable upright member.

9 Claims, 7 Drawing Figures

FIG. 3
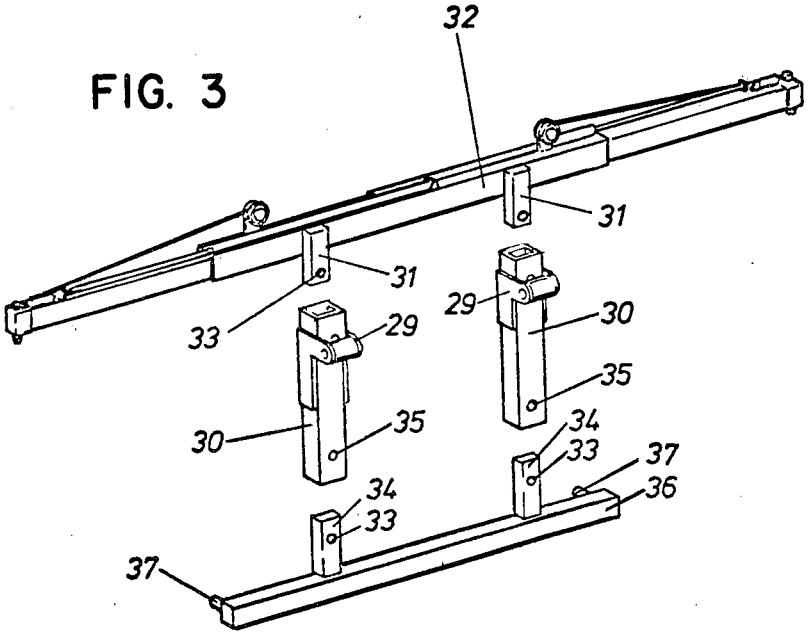
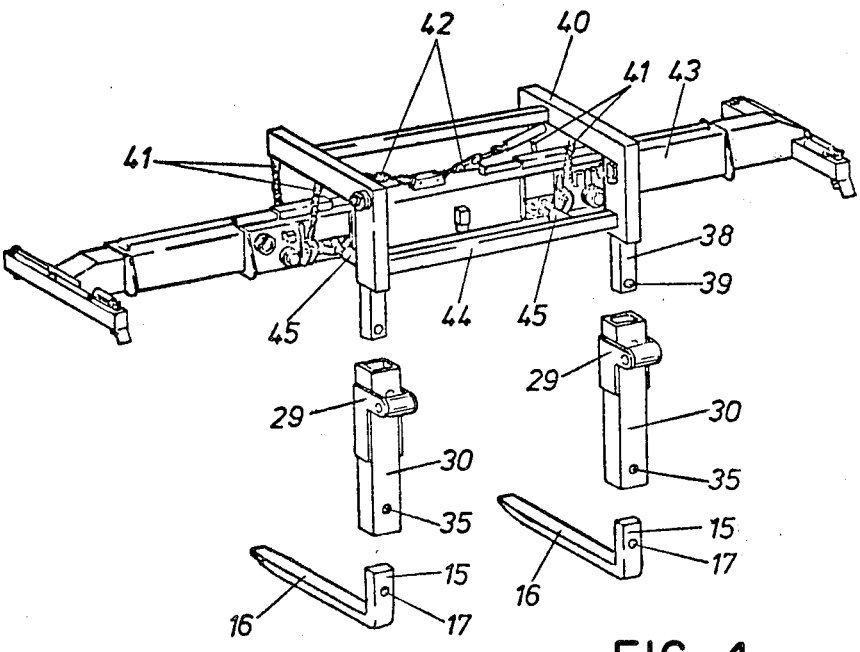
FIG. 4

LOAD CARRYING ARRANGEMENT FOR A LIFT TRUCK

BACKGROUND OF THE INVENTION

The present invention relates to a load carrying arrangement for a lift truck, wherein the truck has a frame and a mounting element which is displaceably mounted on said frame.

There are already known various constructions of lift trucks, among the best known of which are the so-called fork lift trucks. Such lift trucks are self-propelled vehicles which have, usually at their front ends, a support frame or a similar structure on which a mounting element, such as a mounting frame, is mounted at least for up and down movement. Then, carrying means operable for engaging an object to be lifted are mounted on the mounting element for displacement therewith. In some conventional constructions of fork lift trucks, the mounting element is so constructed as to be capable of having a pair of fork prongs mounted thereon. Each of such fork prongs then has a load-engaging portion and a mounting portion which extends at right angle to the load-engaging portion. In one heretofore known arrangement of this type, the mounting portion of each of the fork prongs has an offset at its upper end extending transversely of the remainder of the mounting portion, which is adapted to be engaged with at a correspondingly shaped part of the mounting element and, in order to avoid unintentional or undesired lateral movement of the respective fork prongs relative to the mounting element, a wedge-shaped nose is provided which extends into a recess provided in the mounting element. In this construction, the lower end of the mounting portion abuts against the mounting plate or a similar mounting element. This construction has the disadvantage that each of the fork prongs can be suspended from the mounting element only in such a manner that the load-engaging portion extends from the lower region of the mounting element.

However, this arrangement is suitable only under such circumstances when objects situated at a relatively low elevation are to be lifted, in such a manner that the fork prongs are introduced underneath the object to be lifted. In the event that none of the objects or loads to be lifted is situated at the relatively low elevation, particularly on the floor or another surface over which the fork lift truck is moving, the achieveable lifting height of the conventional fork lift truck is not utilized in an optimum manner.

SUMMARY OF THE INVENTION

Accordingly, one of the principal objects of the invention is to avoid the above-discussed disadvantage of the conventional arrangements of the type here under consideration.

More particularly, it is an object of the present invention to so construct the load-engaging attachment for a lift truck that it can be used, on the one hand, in the heretofore usual manner and, on the other hand, for lifting objects, such as containers, which are not to be engaged in the vicinity of the surface over which the lift truck travels, to higher elevations than heretofore possible.

It is a further object of the present invention to so design the load-engaging attachment and the arrangement for mounting the same on the mounting element as to render it possible to effectuate a rapid change-over between the position of the load-engaging attachment in which it is capable of lifting objects that are to be engaged from below or at relatively low elevation, and a position in which the load-engaging attachment is capable of engaging objects from above or at relatively high elevation and of lifting such objects to an even higher elevation.

It is an additional object of the present invention to develop a load-carrying arrangement in which it is possible to easily substitute one load-engaging attachment for another.

A concomitant object of the present invention is to provide a load-carrying arrangement which is simple in construction, easy to manipulate, inexpensive to manufacture, and reliable in operation nevertheless.

In pursuance of these objects and others which will become apparent hereinafter, one feature of the present invention resides, briefly stated, in a load carrying arrangement for a lift truck having a frame, a mounting element displaceably mounted on the frame, and carrying means operable for engaging an object to be lifted, wherein the arrangement comprises, in combination, two upright elongated members spaced apart from each other and connected at least with relation to the mounting element, and means near an end portion of each upright member for releasably securing the carrying means to the upright members. More particularly, each of the upright member defines a passage which extends longitudinally of the respective upright member, and the releasably securing means includes two mounting projections on the carrying means, each of the mounting projections extending through one end into one of the aforementioned passages, the securing means further including means for positionally fixing the projections in the passages. A particularly advantageous embodiment of the present invention is obtained when the carrying means includes a pair of fork prongs each of which has a load-engaging portion and a mounting portion which constitutes the aforementioned projection, in that these mounting portions can be selectively introduced into the respective passage either through its lower end or through its upper end. In this manner, it is achieved that the load-engaging portions of the fork prongs are in the proper position for engaging objects which are to be picked up at the floor level from below when the mounting portions are introduced into the passages of the upright members from below, and in the proper positions for engaging objects or loads which are to be engaged from above when the mounting portions of the fork prongs are introduced into the passages of the respective upright members from above.

The positional fixing of the mounting portions in the corresponding passages of the upright members can be achieved in various ways, for instance, by using clamping screws when a sufficiently secure transmission of high forces can be achieved in this manner, or by means of engagement of fingers in corresponding recesses at the sides of the individual mounting portion, or, advantageously, in such a manner that corresponding bores are provided, on the one hand, in the upright member and, on the other hand, in the associated mounting portion, whereupon a holding pin or bolt can be introduced into these bores in the aligned positions to arrest the respective mounting portion in this position. However, it is also possible to provide a plurality of such bores either in the respective upright member or in the corresponding mounting portion, which renders it possible to arrest the mounting portion of the respective fork prong in a plurality of positions relative to the corresponding upright member. It is also possible to provide a plurality of equidistant and longitudinally aligned bores in both the mounting portion and the associated upright member, which renders it possible to introduce a plurality of bolts or similar arresting elements into the then aligned bores in the respective upright member and the associated mounting portion.

According to an advantageous further development of the present invention, at least one, but advantageously both, of the upright members is mounted on the mounting element for movement toward and away from the other upright member, so that the distance of the two fork prongs from one another can be adjusted at will or, as the case may be, both of the fork prongs can be simultaneously or consecutively moved in one or the other direction.

In order to render such a lateral movability possible at a low cost and even under loaded conditions, it is proposed, in accordance with a further facet of the present invention, to mount either on the upright member at its lower region or on the mounting portion of the respective fork prong, also at its lower region, a support roller which engages a track provided on the mounting element.

The above-discussed construction of the load carrying arrangement with the two aforementioned hollow upright members mounted on the mounting element renders it possible not only to introduce the mounting portions of fork prongs into the open ends of the passages provided in the upright members, but also directly mount other attachments on the mounting element by way of introducing associated mounting portions into the interiors of the upright members, especially in such a manner that a connecting projection is introducible into each of the passages, these projections being connected with a carrier member on which there is mounted an intermediate part for tilting about an axis extending toward the mounting element, cantilever members for the engagement of a container being, in turn, mounted on the intermediate member. In the event that both of the upright members are mounted on the mounting element for joint movement in the lateral directions, the intermediate member can be provided, at its lower region, with at least one support roller which is again, in turn, an engagement with the mounting element. The load-engaging components, for instance, components constructed to grip a container, can also be mounted on the intermediate member for elevational adjustment and, for this purpose, one or two cylinder-and-piston units can be arranged between the intermediate member and the load-engaging component.

There are known arrangements for lifting and transporting containers, in which two mutually interconnected gallows-like parts are arranged on the lift truck, from which there is suspended, as a load-engaging component for the lift truck, by means of four chains, a so-called spreader. According to an advantageous embodiment within the framework of the present invention, it is possible to directly slide such a component, from which the spreader is suspended by means of the four chains, onto the fork prongs which are introduced into the upright members from above. In this event, it is possible, in accordance with a further advantageous development of the present invention, to additionally arrange a cylinder-and-piston unit between the fork prong or, preferably, in order to make it possible to remove both parts in common, the respective receptacle which is slid onto the respective fork prong, and the spreader, so as to be able to change the angle between the spreader and the longitudinal central plane of the lift truck.

The invention accordingly comprises the features of construction, combination of elements and arrangement of parts which will be exemplified in a construction hereinafter set forth and the scope of the application of which will be indicated in the claims.

BRIEF DESCRIPTION OF THE DRAWING

FIG. 3 is a partially exploded perspective view from the rear of another arrangement in accordance with the present invention;

FIG. 4 is a view similar to that of FIG. 3 but of still another arrangement in accordance with the invention;

DETAILED DESCRIPTION OF THE PREFERRED EMBODIMENTS

Figure 1:
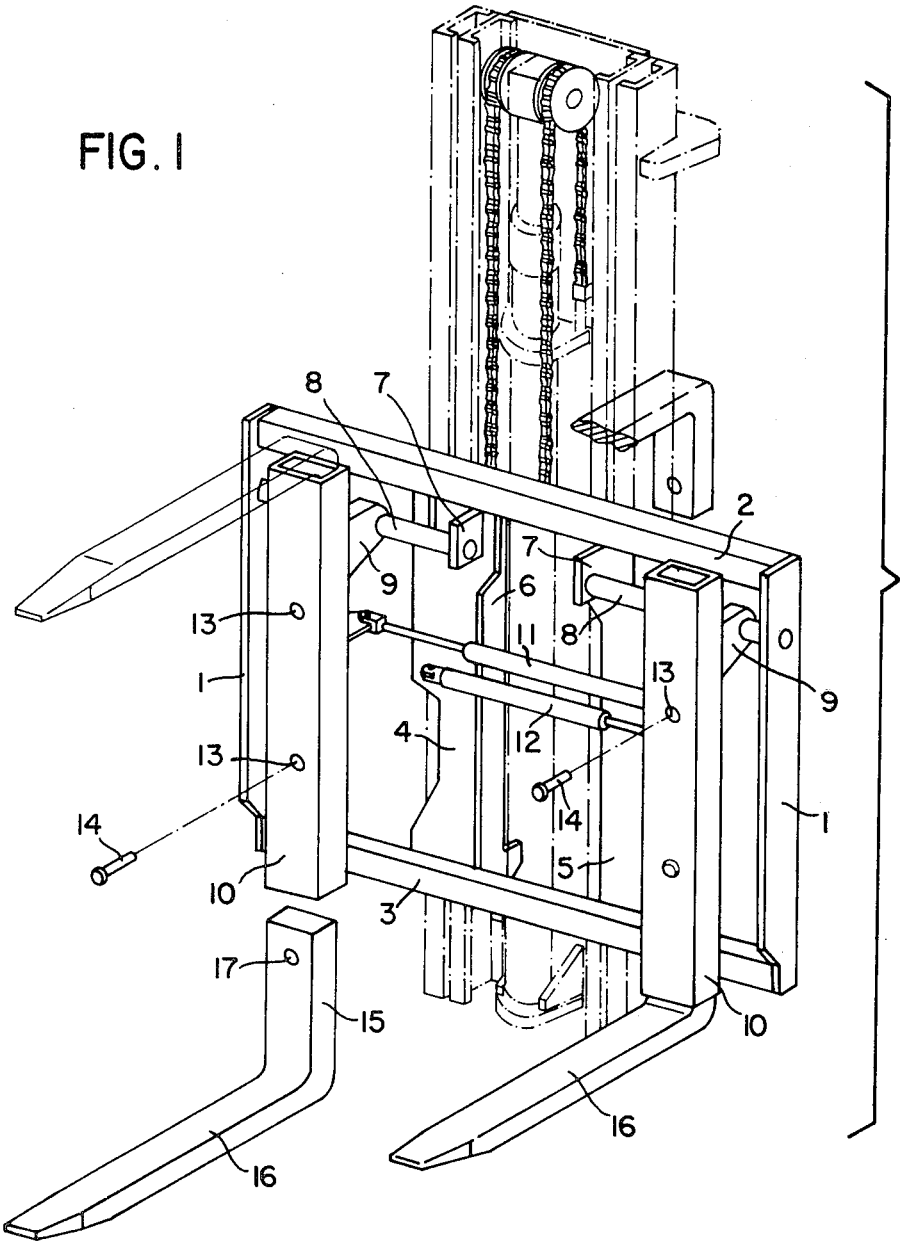
FIG. 1 is a perspective partially exploded view of a mounting element equipped with laterally movable upright members.

Referring now to the drawings in detail, and first to FIG. 1 thereof, it may be seen therein that the arrangement of the present invention includes a mounting element which includes two upright lateral members 1, an upper connecting member 2, a lower connecting member 3, and two intermediate connecting members 4 and 5. This mounting element 1 to 5 can be suspended, in a conventional manner, by means of suspending elements 6, from the prong-mounting plate of the fork lift truck which is displaceably mounted on the frame of the truck. Inasmuch as the lift truck itself as well as the suspension members 6 are constructed and assembled in an entirely conventional manner, and the understanding of this conventional construction is not needed for understanding the present invention, these conventional parts will not be discussed here in any detail. However, it is also possible, in accordance with a further aspect of the present invention, to use the mounting element 1 to 5 instead of, rather than in addition to, the conventional prong-mounting plate.

Each of the intermediate connecting members 4 and 5 is provided with a cantilever extension 7, and a carrier rail 8 is arranged between the respective cantilever extension 7 and the lateral part 1 arranged at the same side. A carrier bracket 9 is mounted on each of the carrier rails 8 for shifting longitudinally thereof, each of such carrier brackets 9 being rigidly connected with a respective elongated upright member 10.

Each of the upright members 10 is provided, at the rear thereof and at its lower end, with a support roller or with a sliding cushion, by means of which the respective upright member 10 is supported on the transverse connecting member 3. The left-hand upright member 10 as considered in FIG. 1 is connected with the intermediate connecting member 5 by means of a cylinder-and-piston unit 11, and the intermediate connecting member 4 is connected with the right-hand upright member 10 by means of a cylinder-and-piston unit 12.

Each of the upright members 10 is provided with two bores 13 into which a respective bolt 14 can be introduced. A mounting portion 15 of a fork prong 15, 16 is selectively introducible into the hollow interior of the respective upright member 10 either from above through the upwardly open end of an internal passage extending longitudinally of the respective upright member 10 or from below through the downwardly open lower end of such passage. Each fork prong 15, 16 includes, in addition to the mounting portion 15, a load-engaging portion 16 which extends substantially normal to the mounting portion 15. A bore 17 is provided in the mounting portion 15 of each of the fork prongs 15, 16, which renders it possible to pass the shank of the bolt 14 through the respective bore 13 of the upright member 10 and through the bore 17 of the respective fork prong 15, 16 whose mounting portion 15 is then accommodated within the respective upright member 10, to thereby positionally fix or arrest the mounting portion 15 with respect to the upright member 10.

As shown in phantom lines in the upper part of FIG. 1, the mounting portions 15 of the fork prongs 15, 16 can be introduced into the internal passages of the upright members 10 selectively from above or from below. The fork prongs 15, 16 will be ordinarily mounted at the lower ends of the upright members 10 when the load-engaging portions 16 are to engage the respective object to be lifted from below at the floor level, while they will be mounted at the upper ends of the upright members 10 when they are to be extended to above a respective container.

Figure 2:
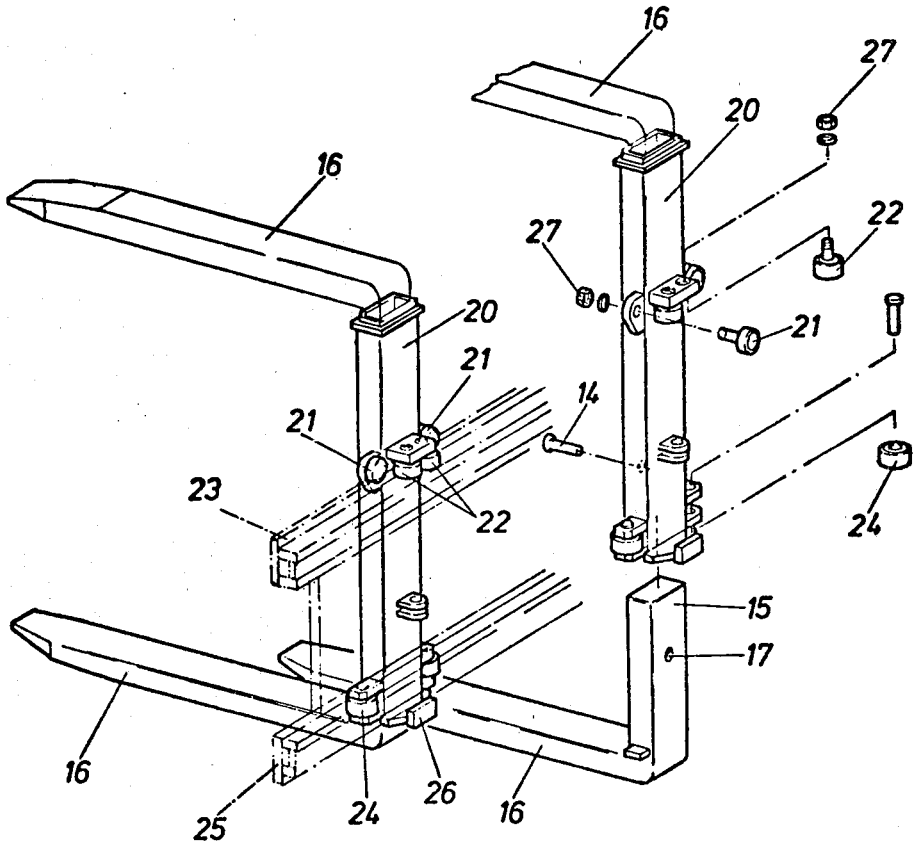
FIG. 2 is a partially exploded perspective view from the rear of an arrangement similar to that of FIG. 1.

In the following discussion of FIGS. 2 to 6, only those parts of the arrangement which are necessary for understanding the present invention will be mentioned, any conventional parts being shown in the drawing only in the phantom lines, if at all. Here again, a thorough disclosure of such parts can be dispensed with in view of the conventionality of such parts, and in order not to unduly encumber the drawings by showing of such conventional parts. FIG. 2 shows two upright members 20 which are generally similar to or even identical with the upright members 10 of FIG. 1. In this construction, each of the upright members 20 is provided, at its upper region, with two rollers 21 which are mounted thereon for rotation about a horizontal axis, and two rollers 22 which are mounted on the respective upright member 20 for rotation about the vertical axis. These rollers 21 and 22 engage a rail 23, which is shown only in phantom lines, and which constitutes a part of a mounting element. Each of the upright members 20 is further provided at its lower end with two rollers 24 rotatable about respective vertical axes which engage another rail 25 of the mounting element which is also shown only in phantom lines. Each upright member 20 is further provided with a tab 26 which extends behind the rail 25 and prevents lifting of the respective upright member 20 from the rail 25 under certain load conditions. Even in this construction, it is possible to selectively introduce the mounting portions 15 of the fork prongs 15, 16 from above or from below into the internal passage of the respective upright member 20. Nuts 27 and interposed washers are used for securing the respective rollers 21, 22 to the upright members 20.

Upright members similar to those of FIGS. 1 and 2 are identified in FIG. 3 by the reference numeral 30. The upright members 30 can be mounted, in a manner similar to that discussed in connection with FIG. 1, on a mounting element of the lift truck, by means of cantilever portions or brackets 29. One mounting portion 31 of a spreader 32 is introducible from above into each of the upright members 30. Each of the mounting portions 31 is provided with a bore 33 operative for accommodating a bolt or similar arresting element. Furthermore, mounting portions 34 can be introduced from below into the upright members 30, these mounting portions 34 being also provided with bores 33 which are in a fitting correlation to bores 35 in other upright members 30, so that arresting bolts or similar elements can be introduced thereinto. The two mounting portions 34 are interconnected by means of a container support member 35, on which there are provided support projections 37 which engage a container to be or being lifted from the side. The spreader 32, which is primarily intended for use in transporting empty containers, is conventional in all other respects than those discussed above so that it is not believed to be necessary to discuss the details of its construction.

In the construction revealed in FIG. 4, the parts 30, 29 and 35 are the same as the corresponding parts discussed above in conjunction with FIG. 3. In this case, the mounting portions 15 of the fork prongs 15, 16 are again introducible into the upright members 30 from below. Mounting portions 38 can be introduced into the upright members 30 from above, these mounting portions 38 respectively constituting parts of a gallows-like carrier member 40 from which there is suspended, by means of chains 41 and 42, a container-spreader 43 which is again of a conventional construction not discussed here and the longitudinal dimension of which can be adjusted. The gallows-like parts 40 are interconnected by means of a connecting means 44. A cylinder-and-piston unit 45 extends between each of the gallows-like parts 40 and the spreader 43. The cylinder-and-piston unit 45 renders it possible to tilt the longitudinal axis of the spreader 43 relative to the plane along which the upright members 30 extend.

Figure 5:
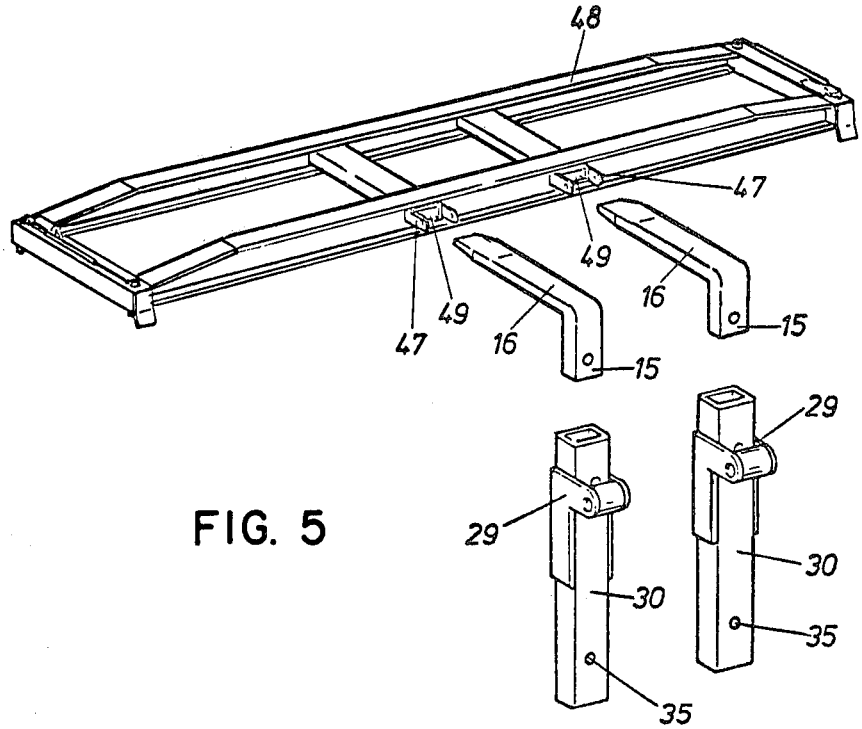
FIG. 5 is a view similar to FIGS. 3 and 4 but of yet another arrangement in accordance with the present invention.

In the construction illustrated in FIG. 5, the parts 29, 30, 35, 15 and 16 again correspond to the parts identified by the same reference numerals in the other Figures. In this case, it is evident that a spreader 48, again of an otherwise conventional construction, is provided with receptacles 49 which can be slid onto the load-engaging portions 16 of the fork prongs 15, 16. Bores are provided in brackets 47 mounted on the spreader 48, these bores 47 accommodating bolts or pins which engage behind the mounting portions 15 of the fork prongs 15, 16 and prevent the otherwise possible sliding of the spreader 48 from the load-engaging portions 16 of the fork prongs 15, 16.

Figure 6:
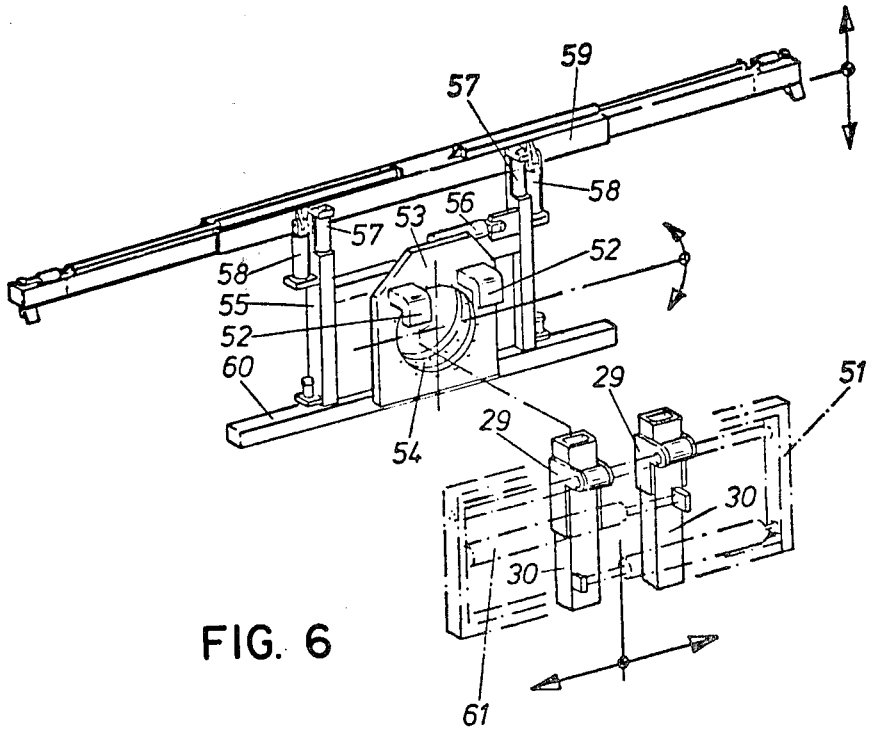
FIG. 6 is a view similar to those of FIGS. 3 to 5 but showing still another arrangement in accordance with the invention.
Figure 7:
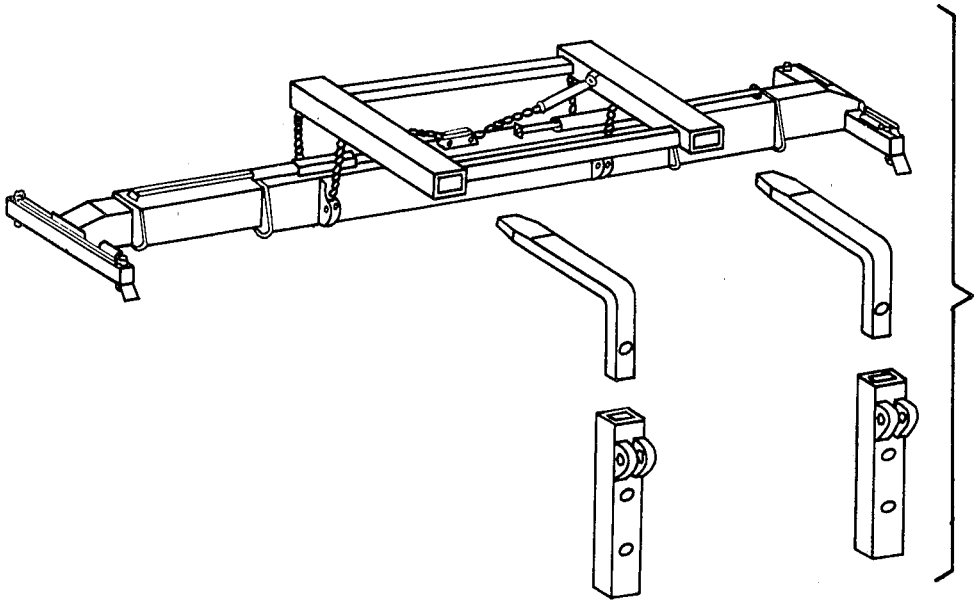
FIG. 7 is an extended perspective view of a further modification.

Finally, in FIG. 6, the upright members 30 are again of the same constructions as those identified by the same reference numerals in the preceding Figures wherein, in this case, the upright members 30 are mounted on a mounting element or plate 51, which is shown only in phantom lines, for lateral displacement, and can be so displaced by means of the respective cylinder-and-piston unit 61. Mounting portions 52 can be introduced into the upright members 30 from above, these mounting portions 52 being rigidly connected with a carrier member 53. A pivoting bearing 54 is mounted on the carrier member 53 and mounts an intermediate member 55 on the carrier member 53 for tilting relative thereto. The tilting movement of the intermediate member 55 is achieved by means of a cylinder-and-piston unit 56. Support columns 57 are telescopically extensibly mounted in the vertical lateral columns of the intermediate member 55, these support columns 57 being vertically shiftable by means of two cylinder-and-piston units 58. A container spreader 59 is supported, again in a conventional manner, on these support columns 57. The intermediate member 55 is provided with a support rail 60 at its lower portion.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A load carrying arrangement for a lift truck having a frame, a mounting element displaceably mounted on said frame, and carrying means operable for engaging an object to be lifted, comprising in combination:

two upright elongated members spaced apart from each other and connected at least with relation to said mounting element, wherein each of said upright members defines a passage extending longitudinally of the respective upright member, and means near an end portion of each upright member for releasably securing said carrying means to said upright member, wherein said releasably securing means includes two mounting projections on said carrying means each extending through one end into one of said passages, and means for positionally fixing said projections in said passages, and wherein said carrying means includes a pair of fork prongs each having a load-engaging portion and a mounting portion constituting said projection and adapted to be selectively introduced into the respective passage through one of its lower and upper ends.

2. A load carrying arrangement as defined in claim 1, and further comprising means for mounting at least one of said upright members on said mounting element for movement toward and away from the other upright element.

3. A load carrying arrangement as defined in claim 2, wherein said mounting means includes at least one roller on one, and at least one track on the other, of said one upright member and said mounting element, said roller engaging said track throughout the range of movement of said one upright member relative to said mounting element.

4. A load carrying arrangement as defined in claim 2, wherein said mounting means includes at least one track on said mounting element, at least one roller mounted on at least one of said fork prongs at the region of merger of said load-engaging portion with said mounting portion and engaging said track, a support member introducible into the respective passage through its lower end, and a support roller mounted on said support member and engageable with said mounting element.

5. A load carrying arrangement as defined in claim 1, wherein said carrying means further includes a container carrier member having two receptacles for accommodating said load-engaging portions of said fork prongs, a container spreader, and four chains suspending said container spreader from said container carrier member, and further comprising a cylinder-and-piston unit extending substantially horizontally between said container spreader and one of said receptacles.

6. A load carrying arrangement as defined in claim 1, wherein said carrying means additionally includes a carrier member having a pair of mounting proportions constituting said projections and adapted to be introduced into said passages, an intermediate member tiltably mounted on said carrier member, and means for engaging a container mounted on said intermediate member.

7. A load carrying arrangement as defined in claim 6, wherein said engaging means is mounted on said intermediate member for elevational adjustment.

8. A load carrying arrangement for a lift truck having a frame and a mounting element displaceably mounted on said frame, comprising at least two open-ended mounting receptacles mounted on said mounting member, at least one load-engaging attachment having at least one load-engaging portion and two mounting portions introducible into the corresponding receptacles through the open ends thereof, and means for positionally fixing each of said mounting portions in the corresponding receptacle, wherein said open ends of said receptacles face downwardly, and further comprising at least two additional receptacles also mounted on said mounting member and having open ends facing upwardly, said mounting portions of said load-engaging attachment being selectively introducible into said mounting receptacles and said additional receptacles.

9. A load carrying arrangement as defined in claim 8, comprising at least two hollow spaced-apart upright elongated members mounted on said mounting element and having lower end portions which constitute said mounting receptacles and upper end portions which constitute said additional receptacles.

* * * * *